United States Patent [19]

Avedikian

[11] 4,443,227

[45] Apr. 17, 1984

[54] INSTANT STARTING BRIQUETTES

[76] Inventor: Souren Z. Avedikian, 1012 N. Ocean Blvd. #909, Pompano Beach, Fla. 33062

[21] Appl. No.: 392,570

[22] Filed: Jun. 28, 1982

[51] Int. Cl.[3] ..... C10L 5/32

[52] U.S. Cl. ..... 44/6; 44/41

[58] Field of Search ..... 44/1 R, 6, 41

[56] References Cited

U.S. PATENT DOCUMENTS

| | | | |
|---|---|---|---|
| 1,839,987 | 1/1932 | Michels | 44/41 |
| 2,289,040 | 7/1942 | Ringer | 44/1 R |
| 2,854,321 | 9/1958 | Stanton | 44/41 X |
| 3,894,848 | 7/1975 | Kleiman et al. | 44/1 R |
| 3,934,986 | 1/1976 | Avedikian | 44/6 |

FOREIGN PATENT DOCUMENTS

| | | | |
|---|---|---|---|
| 66284 | 4/1973 | Japan | 44/24 |

*Primary Examiner*—Carl F. Dees

*Attorney, Agent, or Firm*—Louis E. Marn; Elliot M. Olstein

[57] ABSTRACT

There is disclosed an improved instant charcoal briquette formed by impregnating hexamethylene tetramine in a combustion supporting medium into charcoal briquettes.

3 Claims, No Drawings

INSTANT STARTING BRIQUETTES

FIELD OF THE INVENTION

This invention relates to instant igniting charcoal and briquettes, and more particularly to instant igniting charcoal comprising as well powdered or comminuted coal admixed with starch, and other materials formed and compressed into briquettes readily packaged in paper bags without deleterious effects to the environment or to its igniting properties.

BACKGROUND OF INVENTION

Substantial problems are encountered in the handling and igniting of solid fuels in small pieces or lump forms, such as, for example, charcoal briquettes which are compressed from solid carbonaceous fuel in powdered or finely divided form. Charcoal, one of the solid carbonaceous fuels, is widely used in lump or briquette form as a fuel for grills, barbecues and the like, cooking equipment for broiling, barbecueing and grilling. However, charcoal and other carbonaceous fuels in lump or briquette form have the serious disadvantage when used as a fuel of being extremely difficult to initially ignite in order to obtain combusion thereof sufficient for the fuel to burn to the desired more or less flameless bit of coals or embers required for grilling, barbecueing or other broiling purposes.

For example, with charcoal in lump or briquette form, it is necessary to employ some form of kindling or liquid igniting fuel, such as benzine, kerosene, methylalcohol, and the like, in sufficient quantity to burn for the necessary time to ignite the charcoal which is thereby raised to the point of self burning. With the use of kindling or starting fuels, it is difficult to time the igniting of the charcoal and the combustion thereof to the point where the desired fire is established for properly and satisfactorily grilling and broiling thereover. The use of the liquid fuels has resulted in injury due to flashing and flaming up of the highly volatile substances therein, and generally results in a smoky flame. Additionally, nitrates, nitrites and nitrocelluloses and other easily ignited materials combined with the hereinabove mentioned liquid fuels to assist in the ignition thereof have caused undesirable pyrotechnic effects. All of the prior art materials tend to pollute the air.

Charcoal and similar carbonaceous fuels in lump or briquette form present a further serious disadvantage from the standpoint of transportation, storage and distribution thereof, as well as in handling thereof by the ultimate user as a result of the relatively porous and soft characteristics of such fuels. Such characteristics are of particular disadvantage in bulk handling, transportation and distribution thereof, for dust and soot accumulates therefrom in the containers or carriers resulting, in some instances, in the spontaneous combustion and ignition of the mass of fuel. The soot or dust problems have been of particular problem to the retailer or seller of such fuels to the ultimate consumer. Such retailer merchants have had a reluctance, even when the fuel is bagged and packaged in conventional packaging form to sufficiently stock such packaged fuels because of the space requirements and the difficulty of stacking or placing them in a position readily available to the customer, particularly as a result of the inevitable soiling or sooting of the packages as a result of handling. Consequently, retailers keep only a small supply of such package fuels.

In U.S. Pat. No. 3,934,986 to the instant applicant, there is dislosed a process for preparing an instant starting briquette impregnated with a compound slected from the group consisting of trioxane and tetraoxane with a combustion supporting material which is a solid at ambient temperatures such as disclosed in the prior art, resulting in an improved instant charcoal briquette which could be stored for indefinite periods of time wihtout losing its kindling capabilities, as well as substantially eliminating the problems inherent with the handling of charcoal briquettes, per se. The instant charcoal briquettes as disclosed are safe to use and clean to handle.

However, it was found that, while the improved charcoal briquette had improved shelf life, that extended shelf life could only be realized by the use of a combined packaging system including thermoplastic liners or outer layers, a moisture and vapor-proof barrier.

OBJECTS OF THE INVENTION

An object of the present invention is to provide an improved impregnated carbonaceous fuel which obviates the problems of the prior art.

Still another object of the present invention is to provide an improved impregnated briquette which may be stored for long periods of time without loss of desired properties, without the use of special moisture-vapor transmission barriers.

Still another object of the present invention is to provide an improved impregnated briquette in which the materials used for impregnating the briquettes are safe to handle and the resulting briquettes are clean to handle and are no more hazardous in use than normal, hard-to-burn, untreated briquettes.

SUMMARY OF INVENTION

These and other objects of this invention are achieved in an instant starting briquette which is readily lighted by the application of a match or similar source of heat energy.

It has been unexpectedly found that the incorporation of hexamethylene tetramine (hexamine) together with a combustion supporting medium which is solid at ambient temperatures, such as disclosed in the prior art, as the impregnating liquid for charcoal briquettes, has resulted in an improved instant charcoal briquette which may be stored for indefinite periods of time without losing its kindling capabilities, as well as substantially eliminating the problems inherent with the handling of charcoal briquettes, per se. The instant charcoal briquettes are safe to use and clean to handle. Further, with preferred combustible supporting materials, as hereinafter described, the product of the present invention is safe to handle and the combustion thereof does not yield gases that are any more toxic than ordinary or untreated briquettes.

DETAILED DESCRIPTION OF THE INVENTION

However, Hexamine has a much higher melting point (285° C.–295° C.) as contrasted to a melting point of 61°–62° C. for trioxane. Although both sublime at their respective boiling points, the sublimation of trioxane occurs even at ambient temperatures whereas Hexamine sublimes only at about 230° to 280° C. depending on the environment in which the sublimination occurs. Hence, this is a most important advantage as it makes possible packaging of the impregnated briquettes in the normal, simple, kraft paper bags which are relatively much less costly and easier to obtain. The resulting product is, therefore, energy saving and economical. Yet, it has all of the advantages of an instant starting briquette, and the especial advantage of long shelf life.

The use of Hexamine as a fuel has been suggested for some time, ref. Publication of the Quartermaster Corps. Research and Engineering Center, Natick, Massachusetts entitled "Appraisal of Solid Fuels for Heating Combat Rations" by Harry T. Sherritt and Elizabeth W. Snell dated May 1963. Pages 18 and 19 (Table I) in the appendix of said report list the important comparative data of the several fuels listed.

NEW APPLICATION

No prior art teaches the mixing of a relatively small amount of Hexamine such as 5% or less to as much as 15% dissolved in fatty alcohols, fatty acids, or paraffin wax, including cetyl alcohol, stearyl alcohol and the like. The straight chain aliphatic acids include fatty acids such as palmitic, stearic and the like.

Generally, it is desired to increase the weight of the charcoal substrate by about 10% to 20% by weight of the impregnating mixture. The impregnating mixture is comprised of hexamine and combustion supporting material in a ratio of from about 1 to 20 to 1 to 7. For certain applications, a mixture of combustible materials may be used, e.g., cetyl alcohol with the balance being a fatty acid and another straight chain alcohol such a combination has produced an excellent, non-polluting instant charcoal, when used with hexamine to impregnate and coat a charcoal briquette or substrate. In all instances, it has been found that the instant charcoal of the present invention is inert and safe to store and handle until such time as a flame source is applied thereto.

Impregnation of the charcoal substrate, whether in the form of a briquette or other shapes, may be accomplished by immersing the charcoal substrate, preferably at higher than room temperature, into a molten bath or solution of the hereinabove mentioned impregnation liquid, i.e., Hexamine together with the combustion supporting material, heated to and maintained at an elevated temperature to keep the impregnation material in a liquid state (notwithstanding the possible cooling effect of the charcoal substrate being immersed into the liquid material). This should be nil if possible. The charcoal substrate is usually maintained within the bath for a fraction of one minute to permit the molten solution to penetrate into the interstices of the charcoal substrate.

In a preferred embodiment of the present invention, it is desired to immerse the charcoal while at an elevated temperature, i.e., briquettes as they are withdrawn form the production line and before they are cooled, preferably at 94° C. or higher, into the liquid bath of impregnation material whereby the cooling of the charcoal will effect rapid penetration of the liquid into the interstices of the charcoal substrate. That is the temperature of the briquettes should be higher than the temperature of the impregnating solution. After cooling the impregnated charcoal the product, instant starting briquettes is packaged ready for sale.

The instant starting briquettes with 15% to 20% add-on may have a Hexamine content of 2.25% to 3.0% and function very well. It is apparent that with a 3% Hexamine content and a 17% content of my combustion supporting materials comprising fatty alcohols, fatty acids, and hydrocarbons which when in combination are solid at ambient temperatures, in a substantial amount of combustible materials such as carbon, coal, charcoal, and the like which usually go to make up a charcoal briquette, a most satisfactory instant starting briquette is obtained.

Now, unexpectedly, I have found that by elevating the temperature of my combustion supporting materials to 90° C. to 95° C., I can dissolve a sufficiency of Hexamine in my combustion supporting materials to give a proper impregnating solution with which to impregnate briquettes to produce instant starting briquettes having the desirable properties detailed and referred to in the "Objects of the Invention," above.

The following are critical processing conditions:

(1) Temperature of impregnating solution to be at 90° C. to 95° C.;

(2) Temperature of briquettes to be essentially at equilibrium in a drying oven at above 100° C. to 110° C. just prior to impregnation;

(3) Immersion time of briquettes in the impregnating solution be such as to give a proper quantity of add-on. This is usually a few seconds. If spraying on the impregnating solution, such procedure that proper add-on is obtained.

(4) Concentrations of the several components of the impregnating solution are within essentially the limits shown below.

Fatty acids: 30% to 70%
Fatty alcohols: 10% to 50%
Hexamine: 5% to 15%
Paraffin Wax: 5% to 30%

Commercially available straight chain aliphatic acids, which I call fatty acids for short as in the industry, contain various proportions of $C_{12}$(lauric acid)
$C_{14}$(Myristic and Myristoleic Acids)
$C_{15}$(Pentadecanoic acid)
$C_{16}$(Palmitic, Palmitoleic and Hexadecadienoic Acids)
$C_{17}$(Margaric acid)
$C_{18}$(Stearic, oleic, linoleic, and linolenic acids) and
$C_{20}$(Arachidic acid) and those acids which have double bonds are present in minute amounts-of the order of 0.5% or less.

In my preferred embodiment, a fatty acid mixture highest in palmitic, stearic and oleic acids functioned very well. The presence of the other fatty acids did not impair the performance of the instant starting biquettes.

Until I unexpectedly realized that the low or practical lack of solubility of Hexamine in most organic solvents did not apply to my combination of fatty acid and fatty alcohol combustion supporting materials when they were heated to a relatively high temperature of 90° C. to 95° C., I could not add enough Hexamine to render briquettes into instant starting briquettes. This temperature is considerably above and higher than their average melting temperatures of 40° C. to 62° C.

I have found it desirable to maintain the temperature at about 90° C.–95° C. to effect a proper impregnation of the briquettes. However, reasonably satisfacotry results are obtained at temperatures of as low as 10° C. to 15° C. above the melting temperatures of the impregnating solutions. Once the Hexamine is dissolved at the elevated temperatures, it appears to remain in solution even if the temperature drops below 90° C. for not too long a period of time. Perhaps it remains in a supersaturated state.

Hexamine is higher soluble in warer—1.67 gm. dissolves in 1 gm. of water; in hot water, even more. In 100 cc of each of the following solvents, it dissolves as shown:

Methyalcohol: 7.25 gm. at room temp; 11.93 gm., hot.

$CHCL_3$ (Chloroform): 13.40 gm. at room temp; 14.84 gm. hot.

Less than 3% in Ethyl alcohol; less than 2% in Amyl alcohol.

Less than 0.9% in $CCl_4$; Acetone; Tetrachloroethane, Benzene; and $CS_2$. It is insoluble in light petroleum.

Commercially available straight chain aliphatic alcohols, which I call fatty alcohols for short as in the industry, contain various proportions of ($C_{12}$(Lauryl alcohol or 1-Dodecanol);

$C_{14}$(Myristic alcohol or 1-Tetradecanol);

$C_{15}$(N-Pentadecyl alcohol or 1-Pentadecanol);

$C_{16}$(Cetyl alcohol or 1-hexadecanol);

$C_{17}$(1-Heptadecanol);

$C_{18}$(Stearyl alcohol or 1-Octadecanol); and $C_{20}$(Arachic alcohol or 1-Eicosanol).

In my preferred embodiment, a fatty alcohol mixture available commercially that is highest in the $C_{16}$ and $C_{18}$ alcohols with smaller amounts of the others has functioned very well.

The following examples are illustrations of the instant starting charcoal of the present invention, and it is to be understood that the scope of the invention is not limited thereby.

EXAMPLE 1

An instant starting briquette formed having the following composition:

| | Wt. % |
|---|---|
| Briquette substrate | 80 |
| Fatty alcohols | 6 |
| Fatty acids | 11 |
| Hexamine | 3 |
| | 100 % |

EXAMPLE 2

The impregnating solution for Example 1 had the following composition:

| | Wt. % |
|---|---|
| Fatty alcohols | 31 |
| Fatty acids | 54 |
| Hexamine | 15 |
| | 100 % |

EXAMPLE 3

An instant starting briquette is produced by impregnating ordinary briquette with an impregnating solution whereby the final composition of such instant starting briquette is as follows:

| | Wt. % |
|---|---|
| Briquette substrate | 80 % |
| Fatty alcohols | 10 |
| Fatty acids | 8 |
| Hexamine | 2 |
| | 100 % |

The ignition of the instant charcoal or instant starting briquettes of the present invention is easily accomplished by means of a lighted match. It burns with a gentle flame, the height and intenity of which depend upon the quantity of Hexamine and the combustion supporting materials present therein. The flame of a single lighted briquette may last 3–8 minutes. When a group of briquettes is lit, as would be the case for a barbecue, the flaming period is about 10 to 15 minutes, sometimes 18 minutes or longer. When the flaming period is completed, the briquettes have generally reached a high enough temperature so that they become a bed of glowing embers within less than 30 minutes after the initial ignition of the instant starting briquettes of the present invention. The duration of subed suitable for barbecueing may be as much as 60 to 120 minutes or longer depending upon the conditions of manufacture of the substrate.

While the invention is described as being applicable to the impregnation of charcoal briquettes or substrates, it is understood that other substrates may be used, e.g., coal, coke, woodchips, recycled waste or various other woods or like subtances. It is also understood that the substrate may be formed in various shapes which would not affect the operation of the present invention.

It is contemplated that in one embodiment of the invention, the charcoal substrate would be formed with one or more holes passing therethrough into which there is positioned a cord, string, wick or other fusing means, also impregnated with the impregnation mixture as disclosed above. Upon ignition of the cord or the like, the cord acts as a fuse to ignite the charcoal briquette. A plurality of such instant charcoal briquettes having a hole therethrough may be strung on a cord with a sufficient number thereon to form a normal barbecue bed.

While the invention has been described in connection with several exemplary embodiments thereof, it will be understood that many modifications will be apparent to those of ordinary skill in the art; and that this applcation is intended to cover any adapation or variation thereof what is claimed.

What is claimed:

1. An improved instant igniting charcoal briquette impregnated with a combustion supporting material selected from the group consisting of straight chain aliphatic alcohols, acids, or mixtures thereof which have minimal vapor pressure at room temperatures and mixture of which have a melting point above ambient temperatures and containing hexamine as a combustion initiating agent, said combustion supporting medium constituting from 10% to 20% by weight and said hexamine constituting from 0.75% to 3.0% weight percent of said briquette, said hexamine being admixed with said combustion supporting medium when said combustion supporting medium is above 92° C.

2. Process for preparing instant igniting charcoal briquettes which comprises:

(a) heating a combustion supporting medium to a temperature above about 95° C.;

(b) introducing hexamine into said heated combustion supporting medium to dissolve said hexamine to form a molten bath;

(c) introducing charcoal briquettes into said bath of step (b(; and (d) withdrawing impregnated charcoal briquettes from said bath to form said instant igniting briquettes.

3. The process of claim 2 for preparing instant ignition briquettes wherein said charcoal briquettes are heated prior to step (c).

* * * * *